US006125720A

United States Patent [19]

Gohman

[11] Patent Number: 6,125,720

[45] Date of Patent: Oct. 3, 2000

[54] TOOL FOR REMOVING ROOFING MATERIAL

[75] Inventor: Bret A. Gohman, South Haven, Minn.

[73] Assignee: Malco Products, Inc., Annandale, Minn.

[21] Appl. No.: 09/177,253

[22] Filed: Oct. 22, 1998

[51] Int. Cl.[7] ..... E04D 15/00

[52] U.S. Cl. ..... 81/45; 254/131.5

[58] Field of Search ..... 81/45, 46; 254/131, 254/131.5, 17–18, 21, 25; 299/36.1; D8/88–89, 9–11, 6; 30/169–172

[56] References Cited

U.S. PATENT DOCUMENTS

| | | |
|---|---|---|
| D. 310,773 | 9/1990 | Frady . |
| D. 319,953 | 9/1991 | Macha . |
| D. 320,149 | 9/1991 | Owens . |
| D. 359,434 | 6/1995 | Gibson . |
| D. 377,140 | 1/1997 | Bair . |
| 3,987,827 | 10/1976 | Mills . |
| 4,056,889 | 11/1977 | Barnett, III . |
| 4,086,699 | 5/1978 | Olkkola . |
| 4,091,535 | 5/1978 | Lehrter . |
| 4,182,390 | 1/1980 | Renner . |
| 4,183,144 | 1/1980 | Barnett, III . |
| 4,203,210 | 5/1980 | Hadlick, Jr. . |
| 4,219,238 | 8/1980 | Sanchez . |
| 4,232,906 | 11/1980 | Torbenson . |
| 4,269,450 | 5/1981 | Welborn . |
| 4,277,104 | 7/1981 | Sanchez . |
| 4,324,042 | 4/1982 | Lipka et al. . |
| 4,477,972 | 10/1984 | Testa, Jr. . |
| 4,691,439 | 9/1987 | Marra . |
| 4,699,430 | 10/1987 | Nichols . |
| 4,709,479 | 12/1987 | Lavelette . |
| 4,756,578 | 7/1988 | Mims et al. . |
| 4,763,547 | 8/1988 | Dike, Jr. . |
| 4,809,436 | 3/1989 | Crookston . |
| 4,858,503 | 8/1989 | Dike, Jr. . |
| 4,880,491 | 11/1989 | Jacobs et al. . |
| 4,938,657 | 7/1990 | Benson et al. . |
| 4,972,891 | 11/1990 | Huber . |
| 5,001,946 | 3/1991 | Shirlin et al. . |
| 5,076,119 | 12/1991 | Wenz . |
| 5,159,859 | 11/1992 | Whitesell . |
| 5,207,126 | 5/1993 | Schaben . |
| 5,213,319 | 5/1993 | Crowe et al. . |
| 5,280,676 | 1/1994 | Fieni . |
| 5,495,781 | 3/1996 | Wirth . |
| 5,741,047 | 4/1998 | Ordonez . |
| 5,813,295 | 9/1998 | Jensen, Jr. . |
| 5,893,304 | 4/1999 | Carroll ..... 254/131.5 X |

OTHER PUBLICATIONS

Literature entitled "Before You Star That Job, You Need to See the Boss", Queensbury Products, Inc., Oct. 1996.

(List continued on next page.)

*Primary Examiner*—D. S. Meislin
*Attorney, Agent, or Firm*—Gerald E. Helget; Rider, Bennet, Egan & Arundel

[57] ABSTRACT

A roofing material and roofing fastener removal tool. The tool comprises a handle attached to a blade. In the preferred embodiment, the handle is adjustable relative to the blade. In this embodiment, a portion of an adjustment assembly provides additional pivot points to extend the working range of the blade. The blade includes two rows of material engagement portions. The rows include large teeth and small teeth spaced evenly and regularly along the working edge of the blade. The larger teeth are thinned and rounded to facilitate insertion between roofing material and a structure, while the smaller teeth are thinned on one side only and rounded to facilitate insertion and engagement with roofing material and roofing fasteners. The teeth are separated from each other by tapered slots which are sized to engage shanks of roofing fasteners.

5 Claims, 6 Drawing Sheets

OTHER PUBLICATIONS

Literature entitled "Roof Bully", Roof Shingle Removal Tool, Queensbury Products, Inc., Feb. 1996.
Literature entitled "Before You Star That Flooring Job, You Need to See This Flooring Tool", Queensbury Products, Inc., Nov. 1996.
Tools of the Trade, Fall 1997, p. 56.
Literature from AJC Hatchet Company, Inc., Product Description, Shing–Go Shovels.
Literature from AJC for roofing tools and equipment.
Literature from Vinal Industries, Inc. entitled "The Shingle Eater".
Literature entitled "Rusko's Shingle Ripper".
Product listing, p. 2, Hisco.
Literature from AJC, "Shing–Go Shovels", p. 2.
Literature from Arco Building Systems Company.
Literature from Shingle Thunder.

TOOL FOR REMOVING ROOFING MATERIAL

BACKGROUND OF THE INVENTION

The present apparatus generally relates to a hand tool and more specifically to a roofing material and roofing fastener removal tool.

Modern dwelling construction often utilizes roof coverings comprised of multiple layers of roofing material such as tar paper over which shingles are fastened. Due to the inherent exposure to the elements, roofing materials have a limited effective life. This means that roofing materials must be periodically replaced. Replacement usually requires that all of the roofing materials be removed and replaced with new roofing materials. Since roofing materials are generally attached to a structure by fastening elements such as nails or staples, removal can be difficult, tedious, and dangerous.

Many tools have been developed, with varying degrees of success, to accomplish the task of roofing material and roofing fastener removal. These tools generally perform adequately in that they are able to remove roofing material. However, their use is not without drawbacks. The current removal tools are unable, for example, to be easily and safely adjusted to accommodate differently sized users, and/or different roof pitches. The current removal tools do not provide a plurality of fulcrums which change the levering efficiencies and further fail to extend the working range of the tool as the handle end is rocked upwardly and downwardly. The current removal tools further do not provide a working edge which is specifically designed to simultaneously remove roofing material and roofing fasteners from a structure.

THE PRIOR ART

U.S. Pat. No. 4,086,699, issued to Olkkola, May 2, 1978, teaches a roof stripping tool with a triangularly shaped blade with a plurality of forwardly facing teeth. Note that the teeth are blunt. The blade includes a shoulder which serves as a single fulcrum.

U.S. Pat. No. 4,203,210, issued to Hadlick, Jr., May 20, 1980, teaches a shingle stripper formed by modifying a spade. The patent teaches a blade with a serrated edge which extends along a portion of the working edge of the blade of the spade. Note that the serrated edge extends forwardly of the longitudinal axis of the blade. The patent also teaches the use of a single fulcrum attached at the rear of the blade.

U.S. Pat. No. 4,477,972, issued to Testa, Jr., Oct. 23, 1984, teaches a tool for use in stripping shingles. This patent teaches a triangularly-shaped blade attached to a handle at a predetermined angle. The blade includes a single fulcrum about which the tool is rotated. The patent also teaches V-shaped teeth which extend along the length of the working end of the blade. The tips of the V-shaped teeth are inclined, rounded, and extend forwardly with respect to the longitudinal axis of the blade.

U.S. Pat. No. 4,809,436, issued to Crookston, Mar. 7, 1989, teaches a shingle stripping tool. The tool has a angled blade which is attached to a bracket which includes a tube configured to receive a handle. The blade has a plurality of V-shaped beveled teeth which extend along the length of the working end of the blade. The bracket includes a single fulcrum about which the tool is pivoted.

U.S. Pat. No. 5,280,676, issued to Fieni, Jan. 25, 1994, teaches an apparatus for removing shingles and nails from a roof. The apparatus includes a generally flat blade which is pushed along the surface of a structure. The blade has two working ends, with the forward working end including a plurality of serrated teeth in communication with a plurality of slots which are configured to receive shanks of nails as the blade is pushed forward. The second working end includes a plurality of claws which are configured to engage roofing nails as the blade is pulled backwardly. Note that in use, a worker tilts the handle portion to allow the claws to move smoothly across the top surface of the roof. Note that the serrated teeth of the first end and the claws of the second working and are aligned with the longitudinal axis of the blade.

U.S. Pat. No. 5,813,295, issued to Jensen, Jr., Sep. 29, 1998, discloses a roofing material removal tool. This patent teaches a handle which is adjustable relative to a head. The handle includes a lower end with a transverse pivot pin, and an upper end with an off-center receiving hole. The handle is attached to the head by sliding the pivot pin into upwardly opening retaining hooks on the blade and by inserting a locking pin through the off-center receiving hole of the handle and through holes in a guide ears of the handle. The head includes a single fulcrum about which the tool is pivoted. The working end of the head includes a plurality of detents or teeth for engaging roofing material.

The problem with the above-mentioned shingle removing devices is that they are either non-adjustable, or if adjustable, difficult to manipulate and susceptible to loss and/or misplacement. Their working range is limited by the number and location of pivot points. And, their ability to remove large areas of roofing material and associated roofing fasteners is limited by the configuration of their working ends.

There is a need for a roofing material and roofing fastener removal tool whose blade may be easily and safely adjusted relative to the handle for accommodation of differently sized users, and/or for various roofing operations. There is a need for a roofing material and a roofing fastener removal tool with an extended working range and a plurality of pivot points which change the lifting efficiencies of the handle as it is rocked upwardly and downwardly. And there is a need for a tool with a working end which is configured to remove the maximum amount of roofing material and roofing fasteners from a structure.

SUMMARY OF THE INVENTION

A tool used for removing roofing material and roofing fasteners from a structure.

There are two embodiments. With the first embodiment, the tool comprises a handle which is attached to a blade by an adjustment assembly. The handle includes a proximal end with a D-shaped grip attached thereto, and a distal end which is received in a sleeve or tube of the adjustment assembly. Preferably, the D-shaped grip is of sufficient size to accommodate a gloved hand so that a user of the tool does not have to perform the tedious task of donning and removing gloves during operation thereof. The sleeve of the adjustment assembly has a proximal end and a distal end with the distal end including a transverse aperture and the proximal end including a lock portion comprising a transverse slot with first and second ends. The adjustment assembly also includes a bracket in the shape of a U-shaped channel with legs connected to each other by a web. The bracket is attached to the blade by a plurality of fasteners such as bolts. The bracket has a proximal end and a distal end, with the proximal end including an E-shaped channel whose ends extend toward the distal end of the bracket. Each end is sized to be generally coincident with the slot of the sleeve or tube. The distal end of the bracket includes a transverse aperture which is coextensive with the transverse aperture of the sleeve. The coextensive transverse apertures of the sleeve and the bracket are sized to accept a pivot pin to allow movement of the blade relative to the handle. As the handle and the blade are rotated relative to each other each end of the E-shaped channel comes into alignment with the transverse slot in the sleeve. The handle and the bracket are secured by moving a locking pin (which is preferably constrained for motion between the first and second ends of the transverse slot) into engagement with one of the ends of the E-shaped channel. Adjustment is accomplished by withdrawing the locking pin out of engagement with one of the ends of the E-shaped channel and into the long portion of the channel. The locking pin may be provided with a biasing member which maintains the locking pin in a locking engagement and to prevent accidental or unintended adjustments.

The legs of the bracket include secondary and tertiary pivot points which increase the working range of the blade. The pivot points also provide a user of the tool with progressive leverage efficiencies. As the handle is rotated downwardly, the leverage efficiency becomes progressively less while the lifting distances become greater. Ultimately, the blade may be lifted completely from the surface of a structure.

The blade includes a first portion and a second portion which share a common edge or transition, where the transition functions as a primary fulcrum. The first and second portions define the ends of the blade and include a roofing material contacting surface and a structure contacting surface. The second portion is attached to the bracket of the adjustment assembly and includes a plurality of apertures which are sized to accept suitable fastening elements such as carriage bolts. The first portion of the blade or working end includes two rows of material engagement elements. The forwardmost row comprises finger segments (or large teeth) and the rearwardmost row comprises knuckles (or small teeth). For maximum strength, the finger segments are spaced evenly along regular intervals along the working edge of the blade. The knuckles are positioned, two knuckles per finger, between each finger. The ends of the fingers and knuckles are rounded to prevent snagging of the roofing material and digging-in of the structure surface as the blade of the tool is worked between the roofing material and the structure. In other words, the rounding feature promotes continuity of the materials during the removal process. The surfaces of the fingers are tapered to facilitate insertion of the blade between plys or layers of roofing material. Only the roofing material contacting surface of the knuckles is tapered. The finger segments and the knuckles are spaced from each other by tapered surfaces which are configured to direct roofing fasteners to the apexes formed thereby. The tapered surfaces are configured to engage shanks of roofing fasteners so that they may be either lifted from a structure or severed at the surface. The finger segments and the knuckles are also sized to engage fastening elements which have two parallel legs connected by a web, such as a staple. That is, the finger segments and the knuckle segments are thin enough to be positioned between the legs of staples so that they engage and lift the web of the staple.

The blade itself is somewhat resilient to better resist fracturing and possible injury. The preferred material is steel, however other suitable material may be used. The blade is also provided with a plurality of square apertures which allow attachment of the blade to different handles. Preferably, the apertures are sized to admit square shoulders of attachment bolts so that the bolts resist rotation relative to the blade.

With the tool, roofing materials may be removed by working the blade of the tool between the roofing material and a structure and lifting the roofing material from the structure by rocking the tool about the primary fulcrum of the blade. Roofing fasteners are removed by the action of a plurality of finger segments, knuckles, and tapered slots. As the tool is worked under roofing material, roofing fastener shanks are guided into and engage the tapered slots by the finger segments and knuckles. When the tool is rocked back and forth, the roofing fasteners are lifted from engagement with the structure. In order to maximize the usefulness of this feature, the tapered slots are relatively deep and terminate in rounded ends whose radii are sized to receive the shanks of common roofing fasteners.

The finger segments or large teeth include end portions which are preferably tapered on both the roofing material contacting surface and the structure contacting surface to facilitate insertion, minimize snagging, and maximize integrity of the roofing material and the structure.

In the second embodiment the tool is non-adjustable, wherein the handle is attached directly to the second portion of the blade by appropriate fastening elements. With this embodiment, the handle is provided with a transition portion for attachment to the blade. The transition flattens out toward the distal end of the handle so that in use, the tool presents a reduced surface area onto which roofing substrates and/or roof surfaces may snag or catch. The blade includes the dual rows of large and small teeth as discussed above.

A principal object of the present invention is to remove roofing material and roofing fasteners in an efficient manner.

Another object of the present invention is to provide a roofing material and roofing fastener removal tool which is adjustable.

Another object of the present invention is to simplify adjustment between a handle and a blade of a roofing material removal tool.

Another object of the present invention is to reduce the risk of misplacement or loss of the tool components.

Another object of the present invention is to increase the working range of the blade of the tool.

Still another object of the present invention is to increase the utility of a blade by providing at least two fulcrums.

Another object of the present invention is to prevent shredding of roofing material as it is removed from a structure.

Another object of the present invention is to simplify construction of the tool.

A feature of the present invention is an adjustment assembly which allows the blade of the roofing material removal tool to be selectively positioned relative to the handle.

Another feature is that the handle and the blade are attached to portions of the adjustment assembly.

Another feature of the present invention is the provision of a plurality of pivot points about which the tool may be rotated.

Another feature of the present invention is that the roofing material engaging section has two rows of material engagement portions, with the rows configured to extend beneath and lift roofing material from a structure, and the rows configured to cooperatively engage roofing fasteners.

Yet another feature of the present invention is that roofing fasteners are guided by finger members and knuckles into tapered slots for engagement therewith.

An advantage is that the blade and the handle are always attached to each other.

Another advantage is that adjustment between the blade and the handle is simplified.

Yet another advantage is that the working range of the tool is extended by the provision of a plurality of pivot points.

These, and other objects, features and advantages of the invention will become more readily apparent to those skilled in the art from the detailed description and the accompanying drawings.

DETAILED DESCRIPTION

Figure 1:
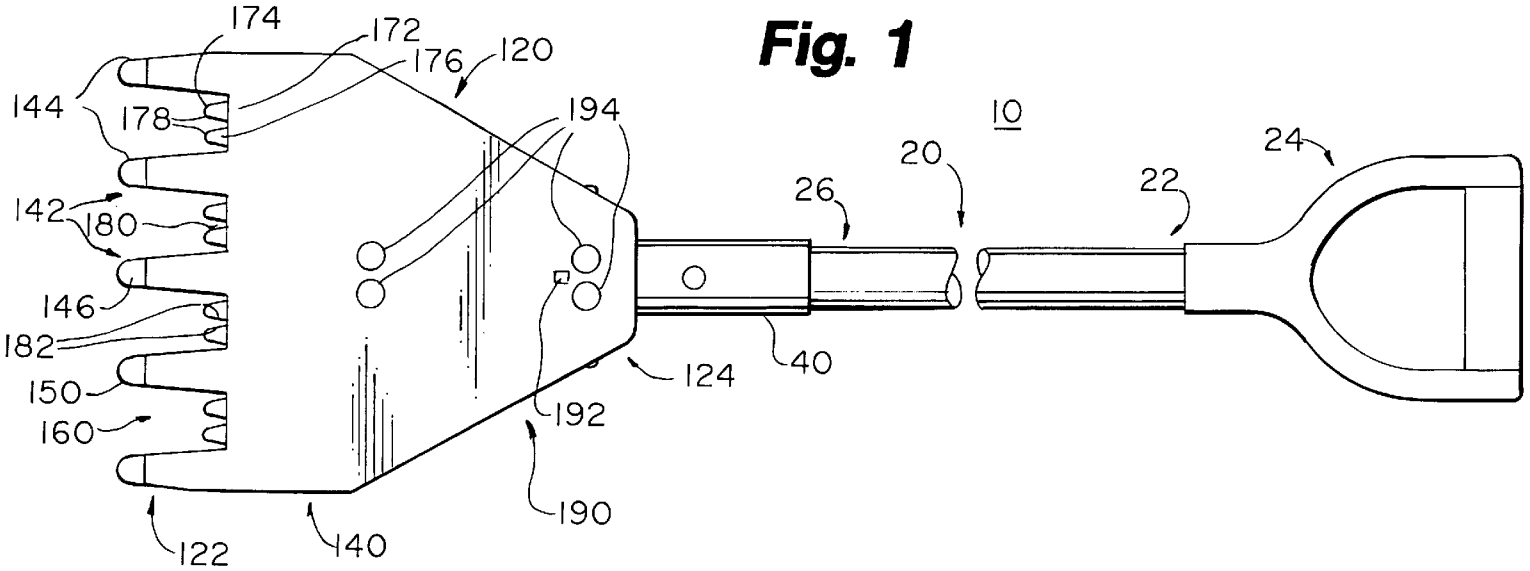
FIG. 1 is a top plan view of a first embodiment of the tool of the present invention.

Referring to FIG. 1 the tool is shown and generally designated with the numeral 10. Tool 10 comprises a handle 20 having a proximal end 22 with a grip 24 attached thereto, and a distal end 26. The distal end 26 is sized to be received within the sleeve 40 of adjustment assembly 30 (not shown). A blade 120 with a first portion 140 having a first or working end 122 and a second portion 190 and a second end 124 is attached to the handle 20 by appropriate fastening elements, such as carriage bolts. First portion 140 and second portion 190 include a common edge 126 which functions as a primary fulcrum (see FIG. 3). First portion 140 includes a plurality of finger segments (or large teeth) 142 which are spaced along the working edge of the blade 120. First portion 140 also includes a plurality of knuckles (or small teeth) 172 which are positioned between finger segments 142. Finger segments 142 include end portions 144 with tapered surfaces 146. Preferably end portions 144 are rounded to present smooth tips 150 which facilitate insertion beneath roofing material. Knuckle segments 172 include one tapered surface 176 and include rounded tips 178 as with the finger segments 142. Finger segments 142 are separated from each other by first notches 160 whose sides are tapered 162. Preferably, two knuckle segments 172 are positioned between each finger segment 142. Each knuckle segment is separated from each other by a second notch 180 with tapered sides 182. And, each knuckle segment 172 is separated from a finger segment by tapered sides 183 (see FIG. 2).

Figure 2:
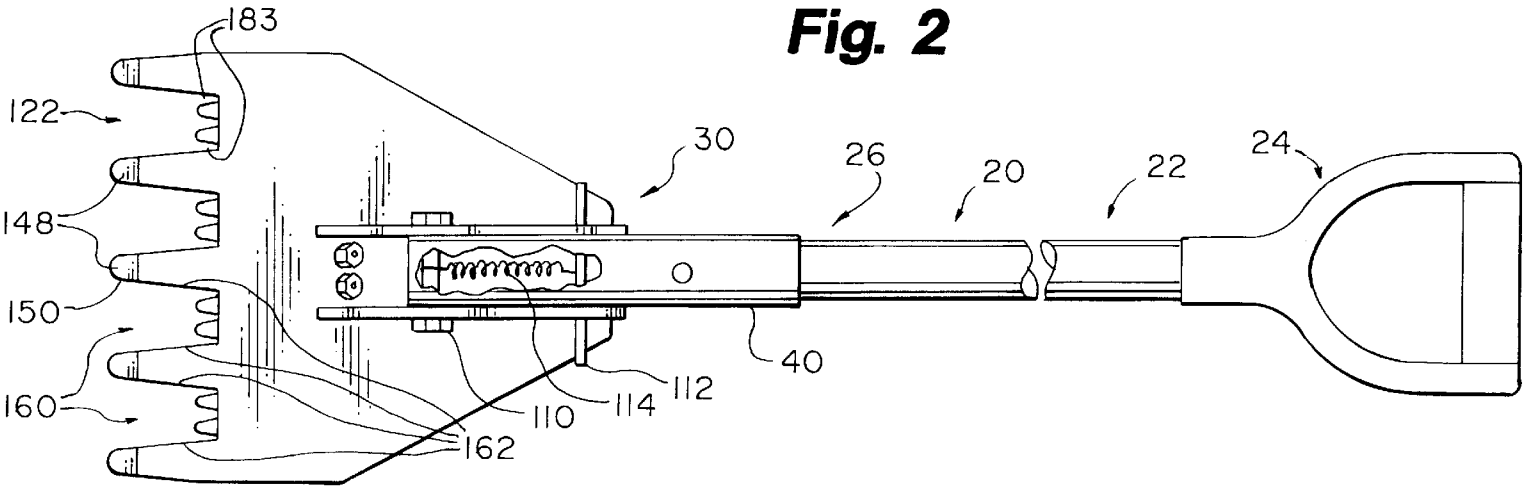
FIG. 2 is a bottom plan view of the tool of FIG. 1 with a portion of the sleeve removed to show the biasing element attached to the pivot and locking pins.

Referring to FIG. 2, adjustment assembly 30 comprises a bracket 60 comprising a U-shaped channel (see FIG. 3) which rotatingly retains sleeve or tube 40 about pivot pin 110. Sleeve 40 lockably engages bracket 60 by aligning lock pin within coextensive slots 90, 92 in the bracket and slot 46 of the sleeve 40. Lock pin 112 is biased into a locking position by a spring or biasing element 114 to prevent accidental or inadvertent movement. As can be seen, blade 120 includes a structure contacting surface 130 which includes tapered end portions 148 of finger segments 142 (FIG. 4).

Figure 3:
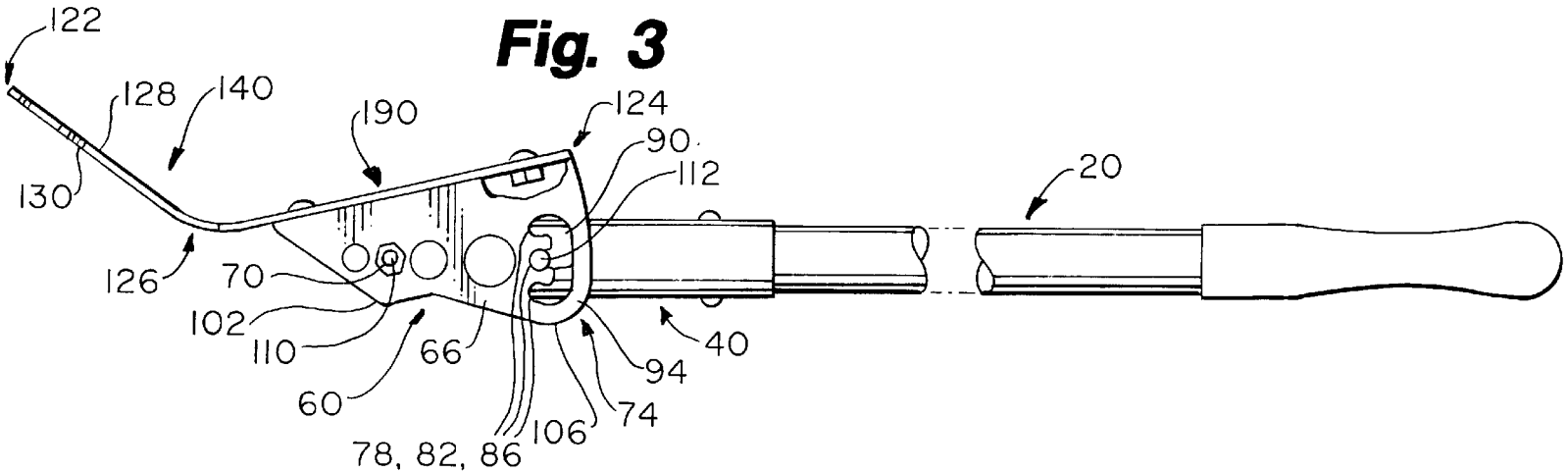
FIG. 3 is a side plan view of the tool of FIG. 1.

Referring to FIG. 3, the adjustment assembly 30 can be more easily seen. Adjustment assembly 30 comprises sleeve or tube 40 and bracket 60, with sleeve 40 and bracket 60 attached to the handle 20 and blade 120, respectively. Since legs 66 and 68 are similar, only one leg 66 will be discussed. Leg 66 includes a first aperture 70 located at one end thereof, and a second lock portion 74 located at the other end thereof. Second lock portion 74 comprises a plurality of apertures 78, 82, 86 which are in communication with an arcuately-shaped slot 90 to form a generally E-shaped channel 94.

As can be seen, leg 66 of adjustment assembly 30 includes secondary and tertiary pivot points 104, 108 which extend the working range of blade 120 as it rotates past transition or primary pivot point 126 of blade 120.

Figure 5:
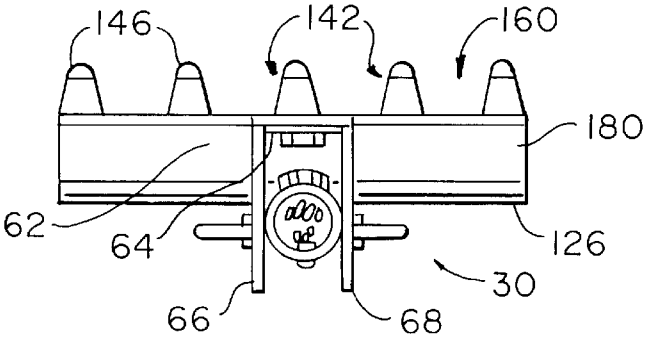
FIG. 5 is a rear plan end view of the tool as depicted in FIG. 1.
Figure 4:
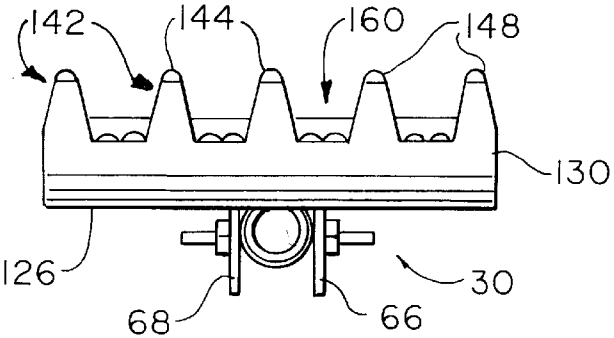
FIG. 4 is a front plan end view of the tool as depicted in FIG. 1.

Referring to FIGS. 4 and 5, structure contacting surface 130 is depicted as being lifted from contact with a structure and being pivoted about pivot points of legs 66, 68. Note that the blade 120 may lifted so that it no longer contacts the surface of a structure, thus the working range of the tool is increased.

Figure 6:
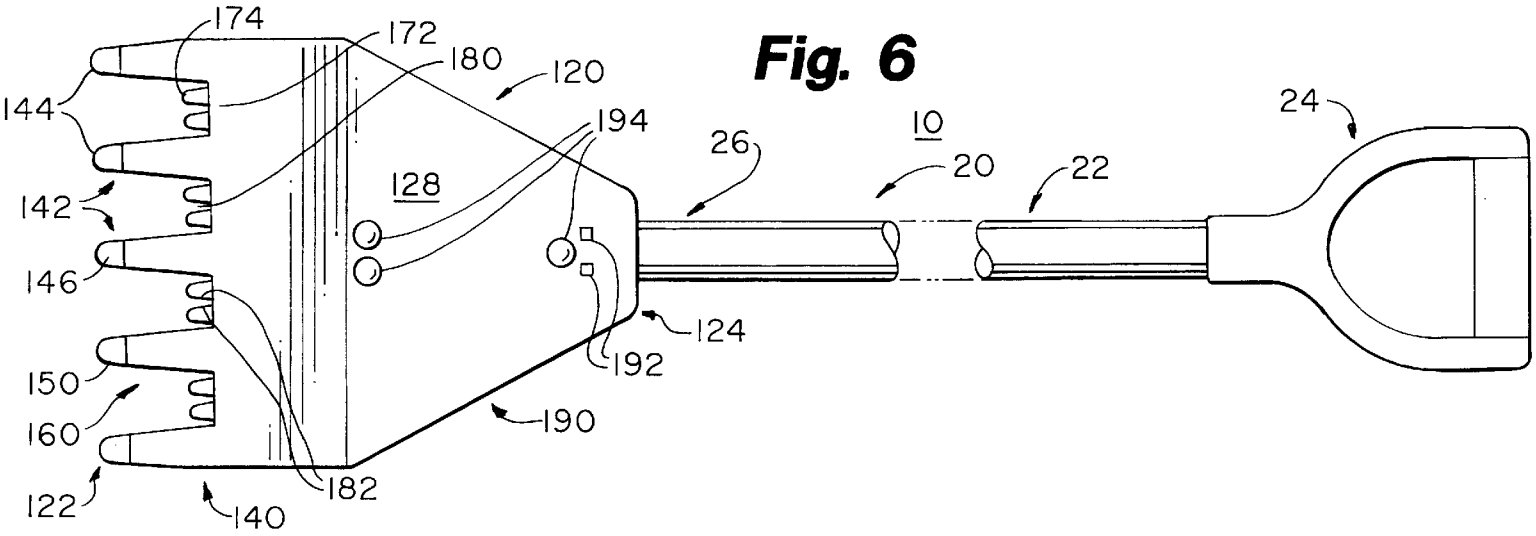
FIG. 6 is a top plan view of an alternate embodiment of the present invention.
Figure 7:
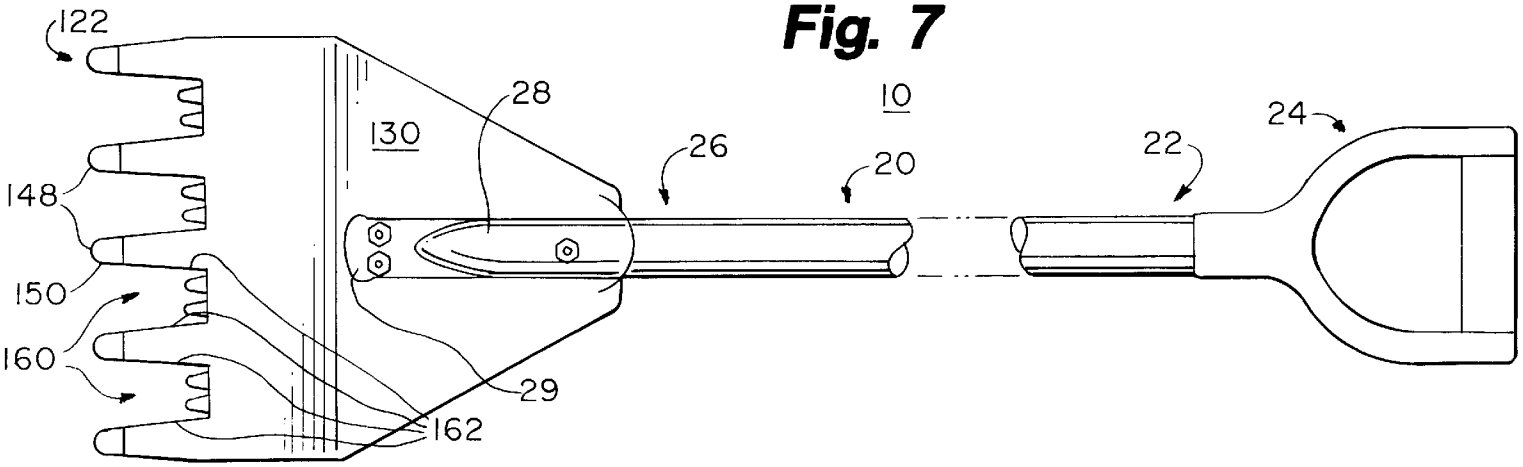
FIG. 7 is a bottom plan view of the alternate embodiment of FIG. 6.

Referring to the second embodiment, FIGS. 6 and 7, the tool 10 comprises many of the features discussed above (see description of FIG. 1), and will not be repeated. As can be seen, however, handle 20 is directly attached to second portion 190 of tool 10, by appropriate fastening elements such as carriage bolts 194. Note that blade 120 includes a plurality of apertures 192, some of which are used for attachment to adjustment assembly 30 as in the first embodiment, some of which are used for attachment to handle 20 in the second embodiment. To facilitate attachment, handle 20 is provided with a transition 28 which terminates in a flattened end 29.

Figure 8:
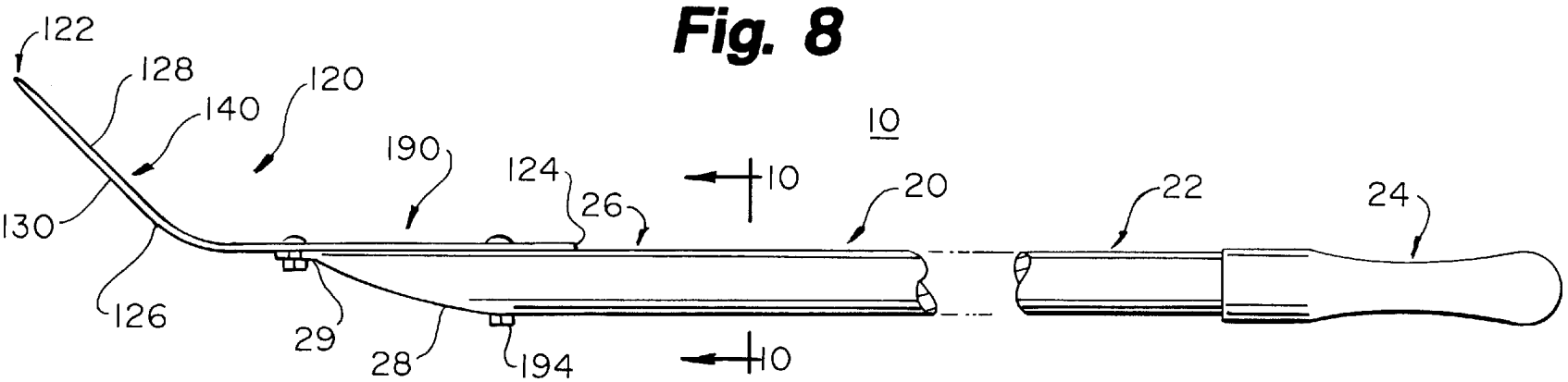
FIG. 8 is a side plan view of the alternate embodiment of FIG. 6.
Figure 10:
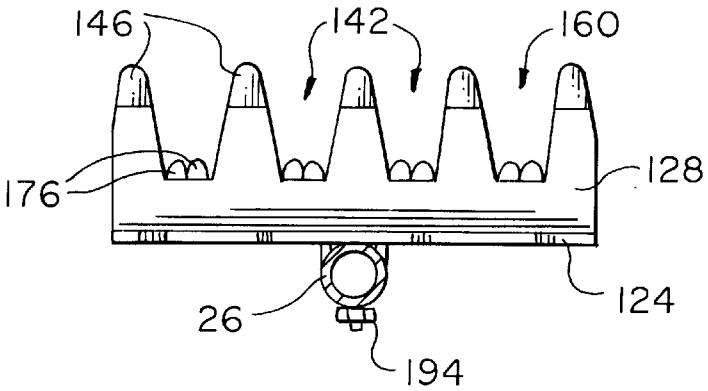
FIG. 10 is a rear plan view of the alternative embodiment of FIG. 6.
Figure 9:
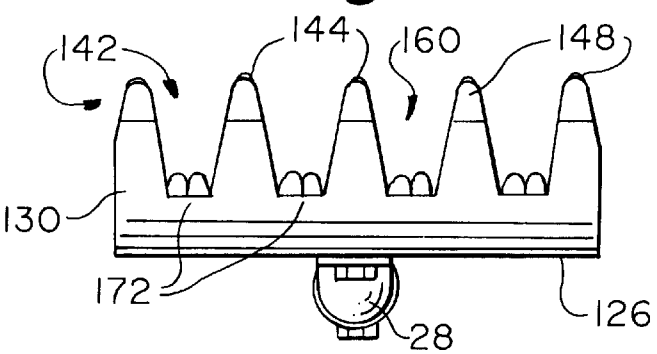
FIG. 9 is a front plan view of the alternative embodiment of FIG. 6.

Referring to FIGS. 8, 9, and 10, note that transition 28 may be used as a secondary pivot point to increase the effective working range of blade 120. Profiles of blade 120 are described above, (see description of FIGS. 3 and 4).

Figure 11:
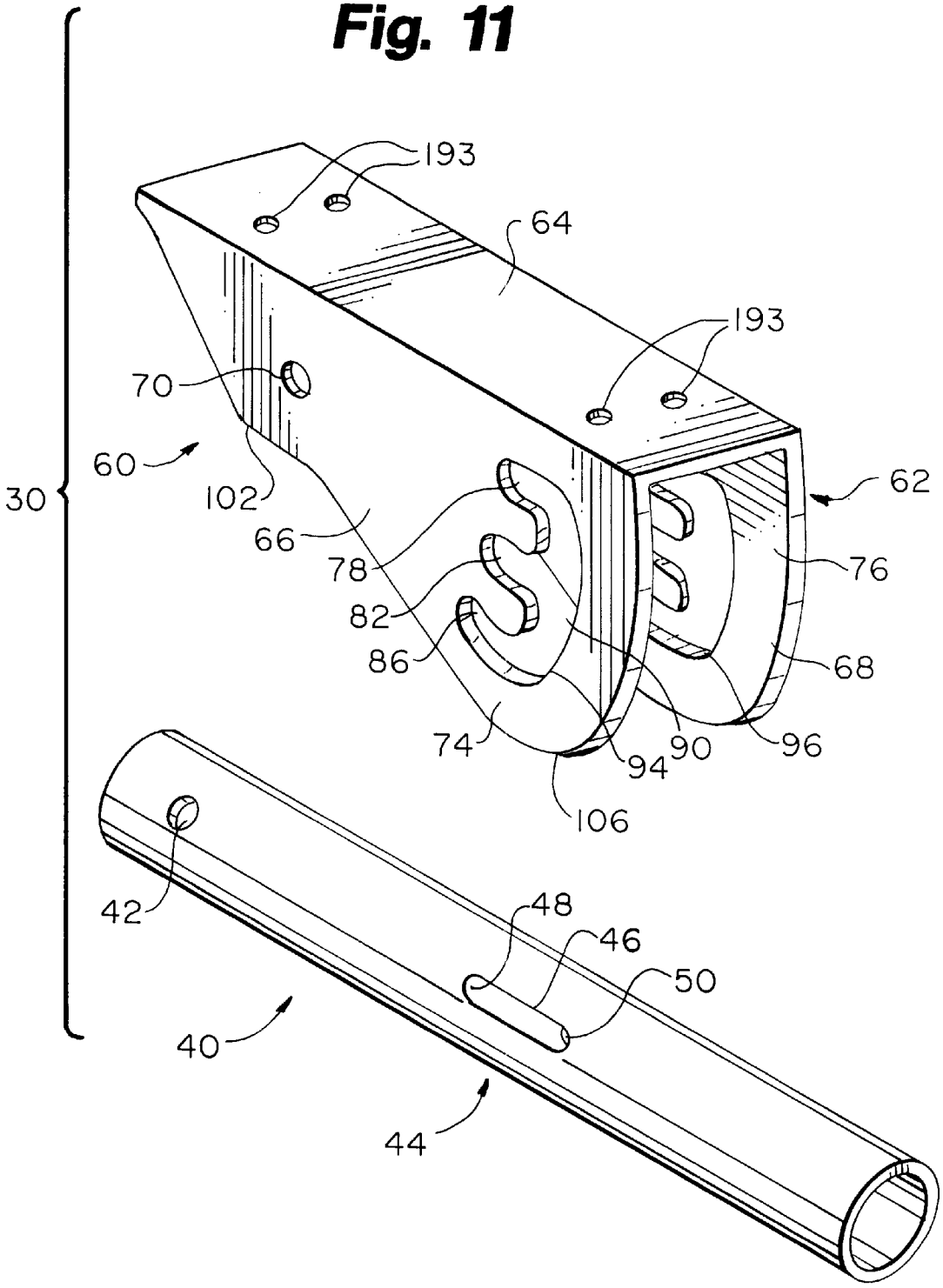
FIG. 11 is an exploded perspective view of the adjustment assembly showing the sleeve and the bracket, but omitting the pivot pin, the locking or lock pin, and the bias element.

Referring to FIG. 11, sleeve or tube 40 includes a transverse aperture 42 located at one end thereof and a first lock portion 44 located at the other end thereof. First lock portion 44 comprises a transverse slot 46 with first and second ends 48, 50. Bracket 60 comprises a U-shaped channel member 62 with a web 64 attached to parallel legs 66, 68. Web 64 includes a plurality of apertures 193 which are coextensive with apertures 192 in blade 120, sized to accept fastening elements 194 (see FIG. 1, for example). Note that apertures 192 are preferably square to accept square shoulders of carriage bolts thus locking the bolts 194 into position relative to blade 120. Legs 66, 68 includes first apertures 70, 72 located at one end thereof, and second lock portions 74, 76 located at the other end thereof. Second lock portions 74, 76 comprises a plurality of apertures 78, 82, 86 and 80, 84, 88, respectively which are in communication with arcuately-shaped slots 90, 92 to form generally E-shaped channels 94, 96.

Figure 12:
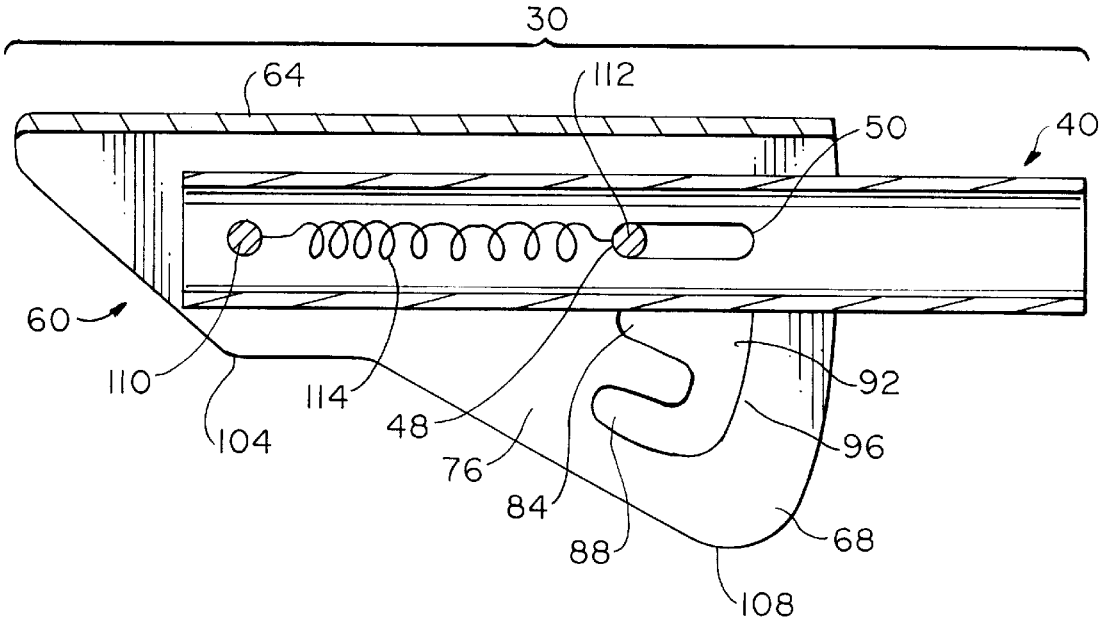
FIG. 12 is a sectional side plan view of the adjustment assembly showing the sleeve attached to and locked into a working position by the bias element.

Referring to FIG. 12, in the assembled or working state, sleeve 40 is pivotally connected to bracket 60 by a pivot pin 110 which is received in apertures 70, 72 of legs 66, 68 and transverse aperture 42 of sleeve 40. Correspondingly, sleeve 40 is lockably attached to bracket 60 by lock pin 112 which moves between the first and second ends 48, 50 of transverse slot 46 and engages the particular end of the E-shaped channels 94, 96 which are in registry with the transverse slot 46. Note that the E-shaped channels and the slot 46 are size-on-size toleranced to avoid slop or relative motion between the bracket 60 and the sleeve 40 when locked into a working position. Biasing element 114 is preferably attached between pivot pin 110 and lock pin 112 so that lock pin 112 is urged toward first end 48 of slot 46.

As can be seen, leg 68 of adjustment assembly 30 includes secondary and tertiary pivot points 102, 106 which extend the working range of blade 120 as it rotates past transition or primary pivot point 126 of blade 120.

In operation, tool 10 is used to remove roofing material and associated roofing fasteners, wherein the working end 122 of the blade 120 is inserted between the roofing material and the surface of a structure. The tool 10 is then worked between the roofing material and the structure by rocking the tool about the primary fulcrum or transition 126 of blade 120 while simultaneously pushing the tool forwardly. As the blade 120 works its way under the roofing material, shanks of roofing fasteners are guided into engagement with the tapered slots 182, 183 between knuckles segments 172 and between knuckle segments 172 and adjacent finger segments 142 of the first portion 140. After the blade 120 has been worked a sufficient distance under the roofing material, the handle 20 is depressed toward the surface of the structure to lift the roofing material and roofing fasteners from contact with the structure.

In the case where roofing fasteners have not been engaged by the slots 182, 183 of the first portion 140 and pull through the roofing material as it is removed from the structure, removal is essentially the same. That is, working the finger segments 142 of the first portion 140 between the upper portion of the fastener and the surface of the structure, and then rocking the handle 20 downwardly toward the structure surface. If the handle 20 does not have sufficient space to pivot downwardly, it may be pivoted upwardly using the tips 150 of the finger segments 142 as a second class fulcrum.

As the tool is rotated about the transition or primary fulcrum 126 of blade 120, roofing material and roofing fasteners may still engage a structure. The tool may then be rotated further to use the secondary and tertiary pivot points 102, 106 of the bracket 60 or the transition 28 of handle 20 to increase the working range of the tool 10.

To adjust the preferred embodiment, all that is required is that the lock or locking pin 112 be withdrawn out of engagement with one of the ends of the E-shaped channel and rotate the sleeve 40 relative to the bracket 60. As another end portion of the E-shaped channel comes into registry with the transverse slot 46 of sleeve 40, spring element 114 will bias lock pin 112 into engagement with an end portion of the E-shaped channel. With this adjustment assembly, the angle of the blade relative to the handle may be selectively positioned between a range of around 135 degrees. Depending upon the configuration of the E-shaped channel, the adjustments may be plus or minus up to 30 degrees.

The present invention may be embodied in other specific forms without departing from the spirit or essential attributes thereof; and it is, therefore, desired that the present embodiment be considered in all respects as illustrative and not restrictive, reference being made to the appended claims rather than to the foregoing description to indicate the scope of the invention.

What is claimed is:

1. An adjustable tool for removing roofing material and roofing fasteners from a structure, the tool comprising:

a) a blade having a first portion, the first portion defining a first end of the blade, the blade having a roofing material contacting surface and a structure contacting surface, the blade forming a primary structure contacting pivot point;

b) an adjustment assembly, the adjustment assembly comprising a bracket and a sleeve pivotally attached to the bracket for motion relative thereto, the bracket attachable to the blade wherein a portion of the bracket extends beyond the structure contacting surface to provide a secondary structure contacting pivot point;

c) a handle having an distal end and a proximal end, the distal end of the handle attachable to the sleeve of the adjustment assembly;

wherein the angle of the blade relative to the handle may be varied by rotating the sleeve of the adjustment assembly relative to the bracket; and, wherein the structure contacting surface and the primary pivot point of the blade may be lifted out of contact with a structure as the tool rotates about the secondary surface contacting pivot point.

2. The tool of claim 1, the bracket of the adjustment assembly comprising a generally U-shaped channel member having a pair of legs, each leg having a first aperture, the first aperture of each leg in axial alignment, the first apertures configured to receive a pivot pin; each leg having a first lock portion configured to receive a locking pin;

the sleeve of the adjustment assembly having a transverse aperture configured to receive the pivot pin, and a second lock portion configured to receive the locking pin.

3. The tool of claim 2, the first lock portion comprising a plurality of apertures, the plurality of apertures in communication with each other by a first arcuate slot, the first arcuate slot sized to passingly admit the locking pin;

the second lock portion comprising a second slot having opposing first and second ends, the second slot extending transversely to, and linearly the sleeve, the second slot sized to passingly admit the locking pin, with the first end of the second slot configured to be in alignment with the plurality of apertures as each pair of apertures is brought into position along the sleeve;

wherein, the blade and the handle may be adjusted relative to each other by moving the locking pin from the first end of the second slot to the second end of the second slot, thereby disengaging the locking pin from the pair of longitudinally aligned apertures and into the first arcuate slot to permit rotation of the sleeve relative to the bracket.

4. The tool of claim 3, further comprising a biasing element, the biasing element imparting a force to the lock pin to bias the lock pin toward the first end of the second slot of the sleeve.

5. The tool of claim 1, the bracket further comprising a tertiary structure contacting pivot point.

* * * * *